US007545354B2

(12) United States Patent
Ha et al.

(10) Patent No.: US 7,545,354 B2
(45) Date of Patent: Jun. 9, 2009

(54) DRIVING CIRCUIT ACTIVE MATRIX TYPE ORGANIC LIGHT EMITTING DIODE DEVICE AND METHOD THEREOF

(75) Inventors: Yong-Min Ha, Guml (KR); Jae-Ho Sim, Daegu (KR)

(73) Assignee: LG. Display Co., Ltd., Seoul (KR)

( * ) Notice: Subject to any disclaimer, the term of this patent is extended or adjusted under 35 U.S.C. 154(b) by 660 days.

(21) Appl. No.: 11/172,479

(22) Filed: Jun. 30, 2005

(65) Prior Publication Data

US 2006/0043366 A1 Mar. 2, 2006

(30) Foreign Application Priority Data

Aug. 31, 2004 (KR) ..... 10-2004-0069348

(51) Int. Cl.
*G09G 3/32* (2006.01)

(52) U.S. Cl. ..... 345/83

(58) Field of Classification Search ..... 345/76, 345/82, 204, 83; 315/169.1, 169.3
See application file for complete search history.

(56) References Cited

U.S. PATENT DOCUMENTS

2003/0098828 A1* 5/2003 Hunter et al. ..... 345/76
2003/0146888 A1* 8/2003 Yamazaki et al. ..... 345/82
2004/0070557 A1 4/2004 Asano et al.
2004/0095298 A1* 5/2004 Miyazawa ..... 345/76

FOREIGN PATENT DOCUMENTS

CN 1487486 4/2004

OTHER PUBLICATIONS

First Notification of Office Action in corresponding Chinese Patent Application No. 200510082442.6, Jan. 4, 2008.

* cited by examiner

*Primary Examiner*—Amr Awad
*Assistant Examiner*—Stephen G Sherman
(74) *Attorney, Agent, or Firm*—Brinks Hofer Gilson & Lione

(57) ABSTRACT

Disclosed are a driving circuit and driving method for an organic light emitting diode (OLED) device. The driving circuit for the OLED device comprises RGB pixels each including: a gate line arranged in a first direction and a data line and a power supply line arranged in a second direction crossing the first direction; a plurality of switching transistors connected to the region where the gate line and the data line intersect; a capacitor connected to the switching transistors and the power supply line; a driving transistor connected to the capacitor and the power supply line; an OLED connected to the driving thin film transistor; a variable voltage signal connected to one of the plurality of switching transistors; and a driving signal connected to at least one of the switching transistors, wherein the variable voltage signal is independently connected to the RGB pixels, and the transistors are thin film transistors.

6 Claims, 8 Drawing Sheets

DRIVING CIRCUIT ACTIVE MATRIX TYPE ORGANIC LIGHT EMITTING DIODE DEVICE AND METHOD THEREOF

PRIORITY CLAIM

This application claims the benefit of the Korean Patent Application No. 69348/2004, filed on Aug. 31, 2004, which is hereby incorporated by reference.

FIELD OF THE INVENTION

The present invention relates to a driving circuit of an active matrix type organic light emitting diode device, and more particularly to, a driving circuit and driving method for an active matrix type organic light emitting diode device, which can improve luminance uniformity between panels by compensating for changes in threshold voltage of a polycrystalline silicon thin film transistor existing between organic light emitting diode devices.

DESCRIPTION OF THE BACKGROUND ART

In recent years, liquid crystal devices (LCDs) are currently most commonly used as a flat panel display (FPD) due to the advantage of light weight and low power consumption.

However, the liquid crystal devices are not a self light emitting element but a light receiving element and have technical restrictions in brightness, contrast, viewing angles, large size, etc. Thus, recently, the efforts to develop new flat panel displays for overcoming such disadvantages have been actively pursued.

An organic light emitting diode, one of the new flat panel displays, is superior to a liquid crystal display in viewing angles, contrast, etc. because it is a self light emitting type, and can be made lightweight and thin, and is advantageous from a power consumption point of view because it requires no backlight.

Additionally, the organic light emitting diode has an advantage that it is strong to an external shock, provides a wide range of temperature because it is capable of direct current low voltage driving, has a fast response speed, and is made entirely in a solid phase. Furthermore, it has a cheap manufacturing cost.

In a manufacturing process of the organic light emitting diode device, all that is needed is deposition and encapsulation equipment unlike a liquid crystal device or PDP (plasma display panel), thus the process is very simple.

If the organic light emitting diode device is driven in an active matrix type having thin film transistors, which are switching devices for each pixel, it shows the same luminance even if a low current is applied. This enables low power consumption, high definition, and large size.

FIG. 1 is a view showing a basic structure of a general active matrix type organic light emitting diode device (AMOLED). In FIG. 1, the general organic light emitting diode display panel comprises gate lines GL1~GLm and data lines DL1~DLn arranged to cross each other on a glass substrate with pixel portions 30 formed respectively in rectangular regions of a matrix pattern defined by the gate lines GL1~GLm and the data lines DL1~DLn crossing each other.

The pixel portions 30 are driven in units of gate lines GL1~GLm by a scanning signal applied via the gate lines GL1~GLm, and generates light corresponding to the intensity of image signals applied via the data lines DL1~DLn.

Therefore, in the organic light emitting diode display panel, a scanning line driving circuit 10 for applying scanning signals to the gate lines GL1~GLm and a data driving circuit for supplying image signals to the data lines DL1~DLn are manufactured on a single crystal silicon substrate, and attached on a glass substrate of the organic light emitting diode display panel in the same method as a taper carrier package (TCP).

In the image display portion, a plurality of gate lines GL1~GLm arranged in a transverse direction at regular intervals and a plurality of data lines DL1~DLn arranged in a column direction at regular intervals cross each other. In the regions defined by the gate lines GL1~GLm and the data lines DL1~DLn crossing each other, pixels 100 electrically connected to the gate lines GL1~GLm and the data lines DL1~DLn are respectively provided.

The pixels 100 are driven in units of gate lines GL1~GLm by a scanning signal applied via the gate lines GL1~GLm, and generates light corresponding to the intensity of image signals applied via the data lines DL1~DLn.

FIG. 2 is a circuit diagram showing a unit pixel of a general active matrix type organic light emitting diode device. In FIG. 2, a gate line GL is formed in a first direction, and a data line DL and a power supply line $V_{DD}$ formed at a given interval in a second direction crossing the first direction, thereby forming one pixel region.

A switching thin film transistor TR2, an addressing element, is connected to the region where the gate line GL and the data line DL intersect. A storage capacitor (hereinafter, referred to as Cst) is connected to the switching thin film transistor TR2 and the power supply line $V_{DD}$. A driving thin film transistor TR1, a current source element, is connected to the storage capacitor Cst and the power supply line $V_{DD}$, and an electroluminescent diode EL is connected to the driving thin film transistor TR1.

The switching thin film transistor TR2 includes a source electrode S1 connected to the gate line GL and supplying a data signal and a drain electrode D1 connected to a gate electrode G2 of the driving thin film transistor TR1, and which switches the electroluminescent diode EL.

The driving thin film transistor TR1 includes a gate electrode G2 connected to the drain electrode D1 of the switching thin film transistor TR2, a drain electrode connected to an anode electrode of the electroluminescent diode EL and a source electrode S2 connected to the power line $V_{DD}$, and serves as a driving device of the electroluminescence diode.

In the storage capacitor Cst, an electrode at one side is commonly connected to the drain electrode D1 of the switching thin film transistor TR2 and the gate electrode of the driving thin film transistor TR1, and an electrode at the other side is connected to the source electrode S2 and of the driving thin film transistor and the power line $V_{DD}$.

The electroluminescence diode EL includes an anode electrode connected to the drain electrode D2 of the driving thin film transistor TR1, a cathode electrode connected to the ground line GND and an organic light emitting layer formed between the cathode electrode and the anode electrode. The organic light emitting layer is comprised of a hole carrier layer, a light emitting layer and an electron carrier layer.

The thus-constructed general organic light emitting diode device (AMOLED) supplies currents through the thin film transistors. Because conventional amorphous silicon thin film transistors are low in carrier mobility, polysilicon thin film transistors with improved carrier mobility have been employed in recent years.

In order to show a minute color change, a good gray scale capability is a must-have function in displays.

The aforementioned organic light emitting diode device displays images by controlling the amount of current flowing in the electroluminescence diode. The organic light emitting diode device displays gray scales by differentiating the amount of light emission of the organic light emitting diode device by controlling the amount of current flowing in the thin film transistors for supplying currents to the organic light emitting diode device in an active driving method.

However, according to a driving circuit and driving method of an organic electroluminescence display device according to the conventional art, the current of the organic light emitting diode is determined according to a gate voltage $V_{IN}$ of a driving polycrystalline silicon thin film transistor TR1.

The driving polycrystalline silicon thin film transistor TR1 operates in a saturation region, thus a flowing current is expressed by the following formula (1):

$$I_{DS}=W/L\,\mu p\,C_{OX}(V_{DD}-V_{IN}+V_{TH})^2 \quad (1)$$

wherein W denotes a channel width of the driving thin film transistor, L denotes a channel length, μp denotes a charge transfer rate, $V_{DD}$ denotes a power supply line, $V_{IN}$ denotes a gate voltage, and $V_{TH}$ denotes a threshold voltage.

If the threshold voltage of the driving polycrystalline silicon thin film transistor TR1 between panels is changed, the current of the driving polycrystalline silicon thin film transistor TR1 and the current of the organic light emitting diode are also changed, thereby making the luminance between panels non-uniform.

SUMMARY OF THE INVENTION

A driving circuit and driving method for an active matrix type organic light emitting diode device, which can improve luminance uniformity between panels by compensating for changes in threshold voltage of a polycrystalline silicon thin film transistor existing between organic light emitting diode devices.

Additionally, a driving circuit and driving method for an active matrix type organic light emitting diode device, may reduce power consumption by gamma compensation by changing a variable voltage Vref value and compensate for the non-uniformity of the characteristics of RGB organic light emitting diodes by applying a variable voltage Vref for each RGB pixel.

A driving circuit for an organic light emitting diode device may comprise a plurality of RGB pixels each including: a gate line arranged in a first direction, a data line arranged in a second direction crossing the gate line, and a power supply line arranged in the second direction, at a given interval from the data line, crossing the gate line; a plurality of switching thin film transistors connected to the region where the gate line and the data line intersect; a storage capacitor coupled to at least one of the switching thin film transistors and the power supply line; a driving thin film transistor connected to the storage capacitor and the power supply line; an organic light emitting diode coupled to the driving thin film transistor; a variable voltage signal connected to one of the plurality of switching thin film transistors; and a SELECT signal connected to at least one of the plurality of switching thin film transistors, wherein the variable voltage signal is independently connected to the each of the RGB pixels.

Each of the RGB pixels comprises: a first switching thin film transistor connected to the data line; a storage capacitor connected to the first switching thin film transistor; a driving thin film transistor connected to the storage capacitor and the power supply line; and a second switching thin film transistor connected to the driving thin film transistor.

The driving circuit of the organic light emitting diode device may comprise: a third switching thin film transistor connected to the second switching thin film transistor connected between the first switching thin film transistor and the storage capacitor to be coupled to the variable voltage signal; and a fourth switching thin film transistor connected to the storage capacitor and between a gate and a drain of the driving thin film transistor, coupled to the first switching thin film transistor and connected to the SELECT signal.

The second switching thin film transistor and the third switching thin film transistor may be coupled to the EM signal.

In the driving circuit for the organic light emitting diode device, each of the RGB pixels may comprise: a first switching thin film transistor connected to the data line and coupled to the SELECT signal; a second switching thin film transistor connected between the first switching thin film transistor and the storage capacitor and coupled to the variable voltage signal; and a third switching thin film transistor connected to the storage capacitor and between a gate and a drain of the driving thin film transistor.

The gate of the second switching thin film transistor may be coupled to the EM signal.

In the driving circuit for the organic light emitting diode device, each of the RGB pixels may comprise: a first switching thin film transistor connected to the data line and coupled to the SELECT signal; a second switching thin film transistor connected between the first switching thin film transistor and the storage capacitor and coupled to the variable voltage signal; and a third switching thin film transistor connected to the storage capacitor and between a gate and a drain of the driving thin film transistor.

The gate of the second switching thin film transistor may be coupled to the SELECT signal.

There is provided a method of driving an organic light emitting diode device according to the invention, wherein a plurality of RGB pixels are driven by: arranging a gate line in a first direction; arranging a data line in a second direction crossing the gate line; arranging a power supply line in the second direction, at a given interval from the data line, crossing the gate line; connecting a plurality of switching thin film transistors to a region where the gate line and the data line intersect; connecting a storage capacitor to the switching thin film transistors and the power supply line; connecting a driving thin film transistor to the storage capacitor and the power supply line; connecting an organic light emitting diode to the driving thin film transistor; connecting a variable voltage signal to one of the plurality of switching thin film transistors; and connecting a SELECT signal connected to at least one of the plurality of switching thin film transistors, wherein the variable voltage signal is independently connected to the RGB pixels and a variable voltage used for preserving a data voltage stored in the respective storage capacitors of the RGB pixels for one frame to adjust the current value of the respective organic light emitting diodes of the RGB pixels.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
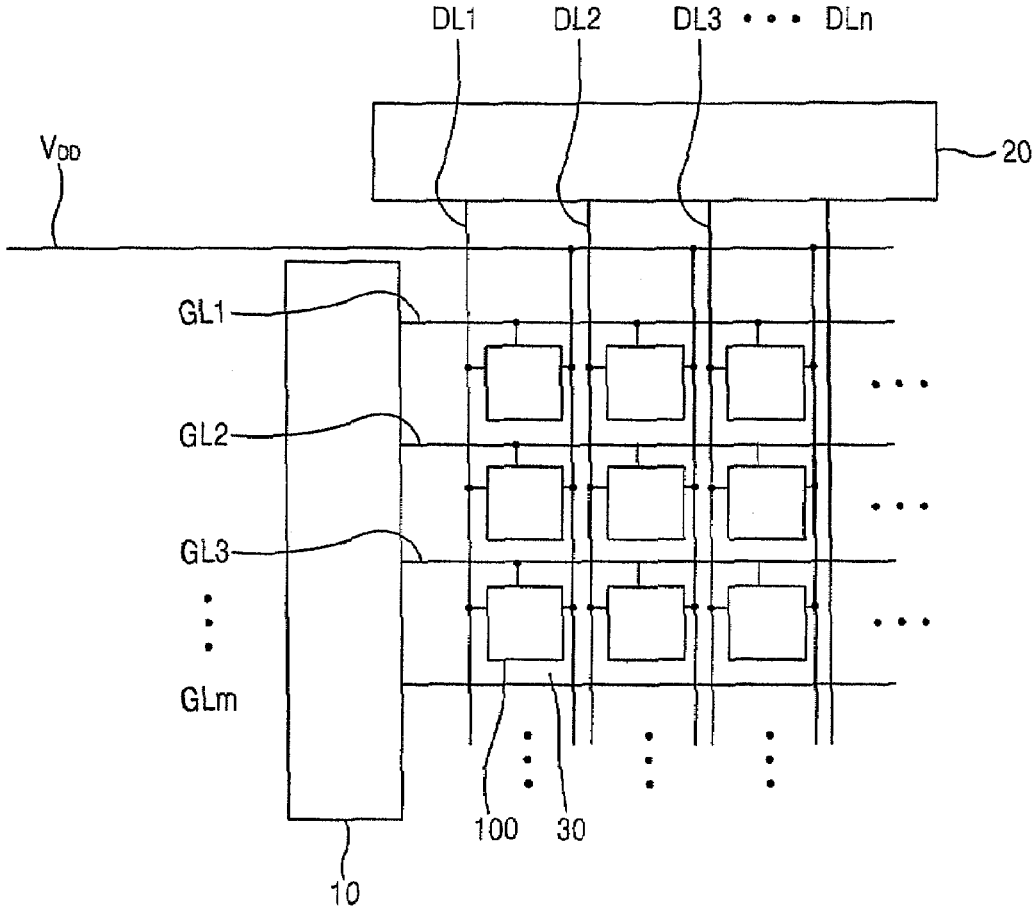
FIG. 1 PRIOR ART
FIG. 1 is a view showing a basic structure of a general active matrix type organic light emitting diode device (AMOLED)
Figure 2:
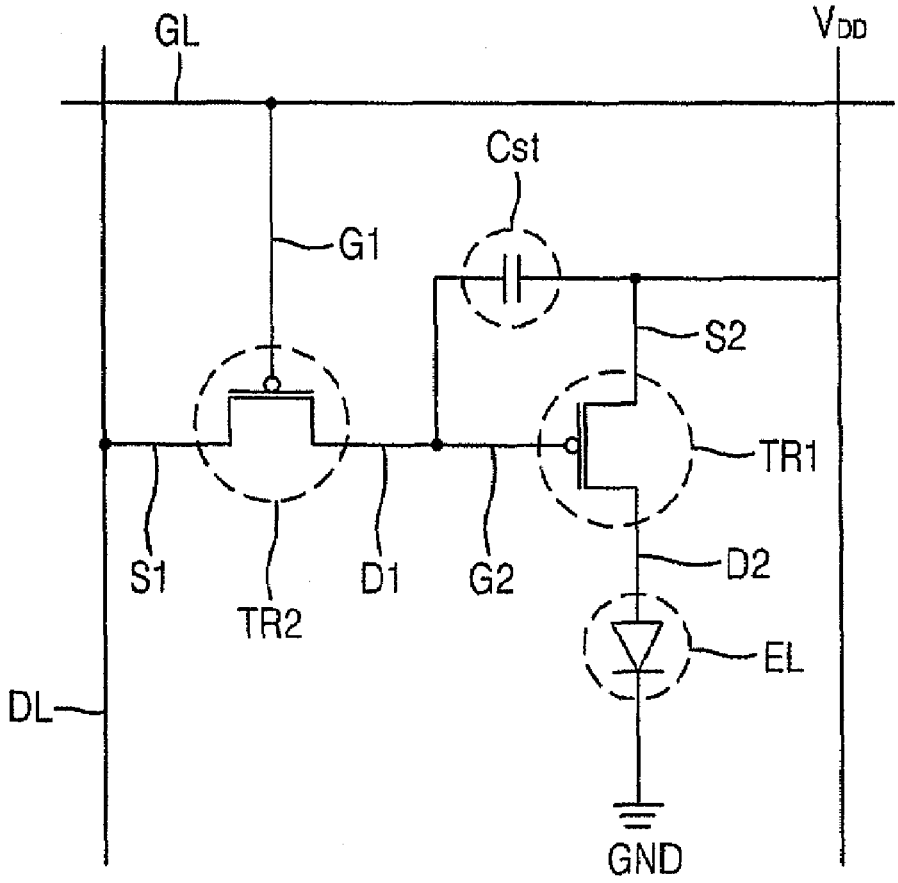
FIG. 2 PRIOR ART
FIG. 2 is a circuit diagram showing a unit pixel of a general active matrix type organic light emitting diode device.
Figure 3:
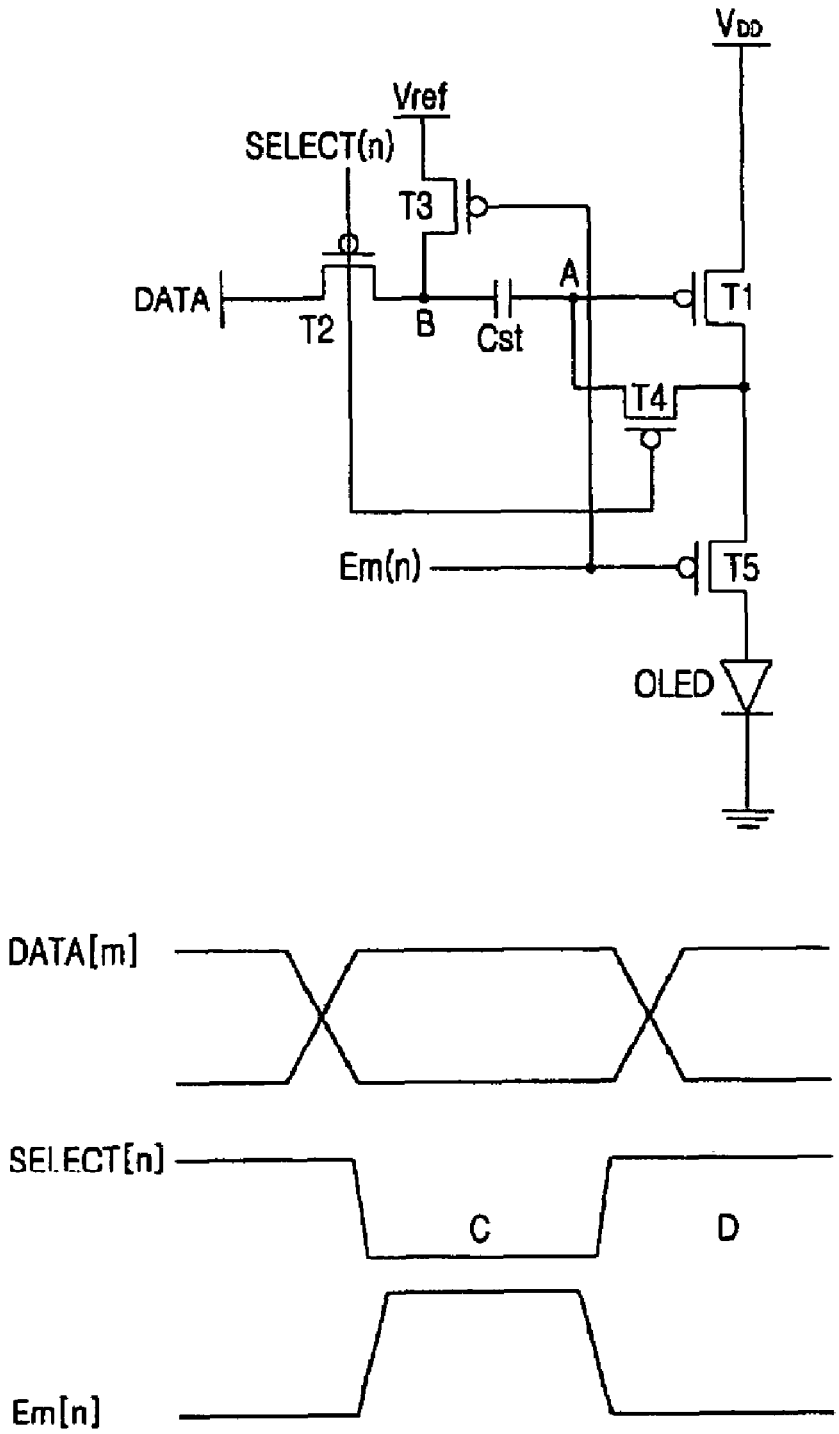
FIG. 3 is a circuit block diagram showing a unit pixel of an organic light emitting diode device according to a first embodiment of the present invention.
Figure 4:
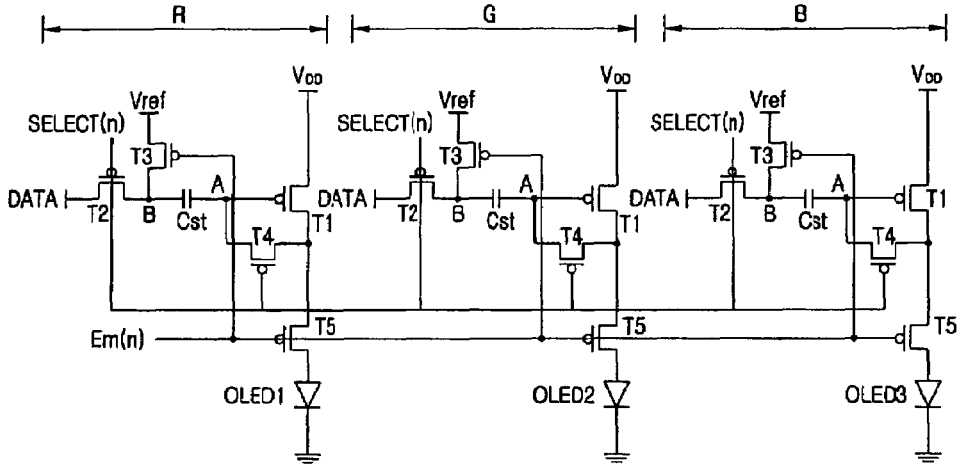
FIG. 4 is an exemplary view showing the organic light emitting diode device to which a Vref voltage for each RGB pixel is applied according to the first embodiment of the present invention.

FIG. 3 is a circuit block diagram showing a unit pixel of an organic light emitting diode device according to a first embodiment of the present invention. FIG. 4 is an exemplary view showing the organic light emitting diode device to which a Vref voltage for each RGB pixel is applied according to the first embodiment of the present invention.

In the organic light emitting diode device according to the first embodiment of the invention, a gate line (not shown) is formed in a first direction, and a data line (not shown) and a power supply line $V_{DD}$ formed at a given interval in a second direction cross the first direction, thereby forming a pixel region.

A first switching thin film transistor T2, an addressing element, is connected within a pixel region. A storage capacitor (hereinafter, referred to as Cst) is connected to the first switching thin film transistor T2 and the power supply line $V_{DD}$, via transistor T4. A driving thin film transistor T1, a current source element, is connected to the storage capacitor Cst and the power supply line $V_{DD}$, and an organic light emitting diode OLED is connected to the driving thin film transistor T1.

A second switching thin film transistor T3 is connected between the first switching thin film transistor T2 and the storage capacitor Cst; a third switching thin film transistor T4 is connected between the gate and drain of the driving thin film transistor T1, and is connected to the storage capacitor Cst; and a fourth switching thin film transistor T5 is connected between the driving thin film transistor T1 and the organic light emitting diode OLED.

The gate of the third switching thin film transistor T4 is connected to the first switching thin film transistor T2 to be coupled to a SELECT (n) signal.

The gate of the second switching thin film transistors T3 is connected to the gate of the fourth switching thin film transistor T5 to be coupled to an EM (n) signal.

The source of the second switching thin film transistor T3 is connected to a variable voltage Vref, which is a DC voltage.

The thus constructed driving circuit and driving method for an organic light emitting diode device according to the first embodiment of the present invention will be described with reference to FIGS. 3 and 4.

In FIG. 3, the first and third switching thin film transistors T2 and T4 are turned ON at the section C where the SELECT (n) is turned ON.

At this time, an A node voltage is initialized to a $V_{DD}-|V_{TH}|$, and a B node voltage becomes $V_{DATA}$.

The second switching thin film transistor T3 is turned ON at the section D where the SELECT (n) is turned OFF and the EM (n) is turned ON, whereby the B node voltage becomes a variable voltage Vref, which is a DC voltage.

The A node voltage is boostrapped by the change rate ($V_{DATA}$−Vref) of the B node voltage, and becomes "$V_{DD}-|V_{TH}|-V_{DATA}-Vref$".

In summary of this result, the current of the driving thin film transistor T1 may be shown as the following expression (2):

$$I_{OLED}=\tfrac{1}{2}K(|V_{GS}|-|V_{TH}|)^2=\tfrac{1}{2}K(V_{DD}-V_{DD}+|V_{TH}|+V_{DATA}-Vref-|V_{TH}|)^2=\tfrac{1}{2}K(V_{DATA}-Vref)^2 \quad (2)$$

Wherein K is u×Cox×W/L

Resultantly, the current $I_{OLED}$ becomes a function of $V_{DATA}$ and Vref

The $I_{OLED}$ value can be adjusted by adjusting the variable voltage Vref, which is a DC voltage used for preserving a data voltage stored in the storage capacitor Cst for one frame.

As shown in FIG. 4, chromaticity and gamma values can be adjusted by such a circuit construction where the variable voltage Vref supply signals are disposed for each RGB pixel configured by the circuit construction as shown in FIG. 3.

It is easier to compensate for the non-uniformity of the characteristics of the RGB organic light emitting diodes (OLED1, OLED2, OLED3) by applying a Vref when no current flows through driving transistor T1 as compared to a conventional structure where $V_{DD}$ is applied and the current flowing through driving transistor T1 is adjusted.

A driving circuit for an organic light emitting diode according to a second embodiment will be described with reference to the accompanying drawings.

Figure 5:
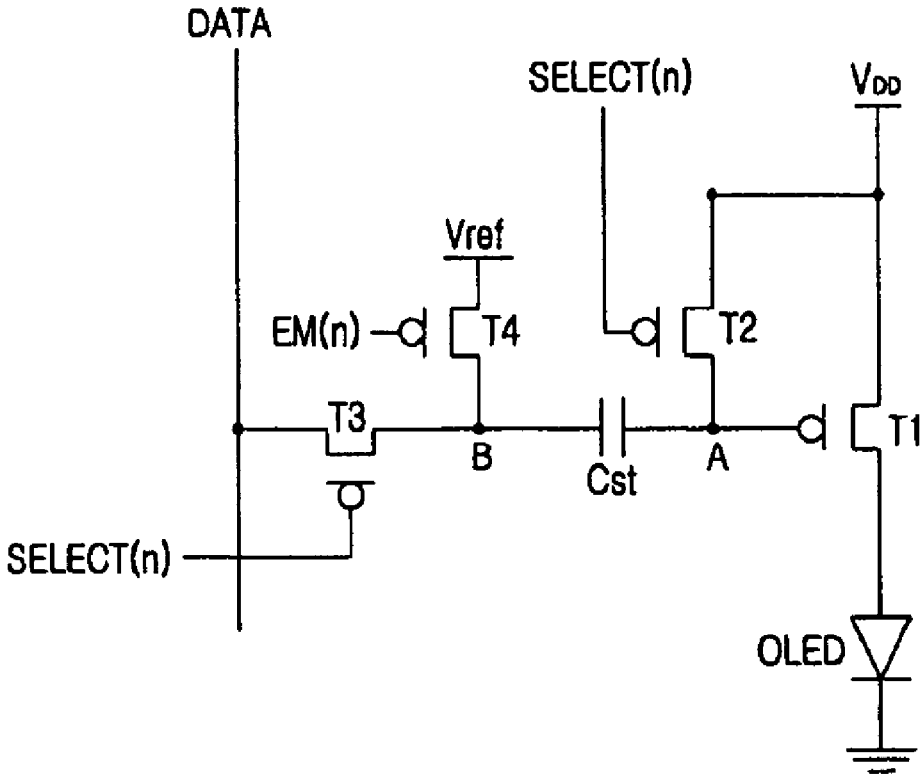
FIG. 5 is a circuit block diagram showing a unit pixel of an organic light emitting diode device according to a second embodiment of the present invention, in which Vref is used in order to preserve information stored in Cst for one frame like in the first embodiment of the present invention.
Figure 5:
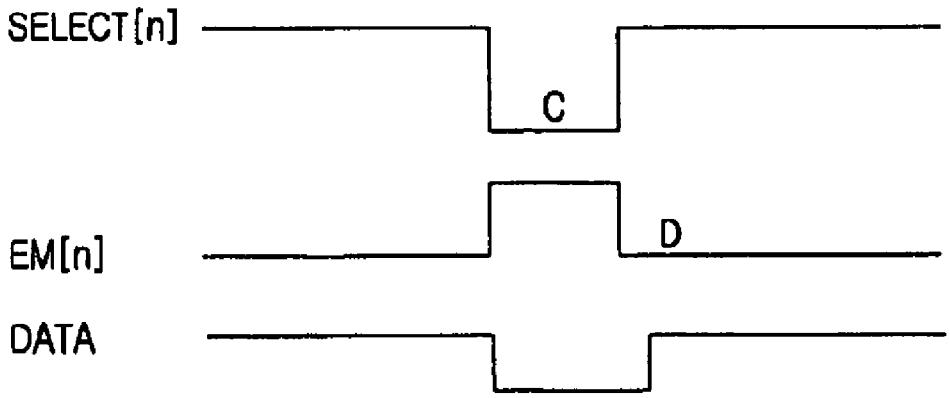

FIG. 5 is a circuit block diagram showing a unit pixel of an organic light emitting diode device according to a second embodiment of the present invention, in which Vref is used in order to preserve information stored in Cst for one frame like in the first embodiment of the present invention.

Figure 6:
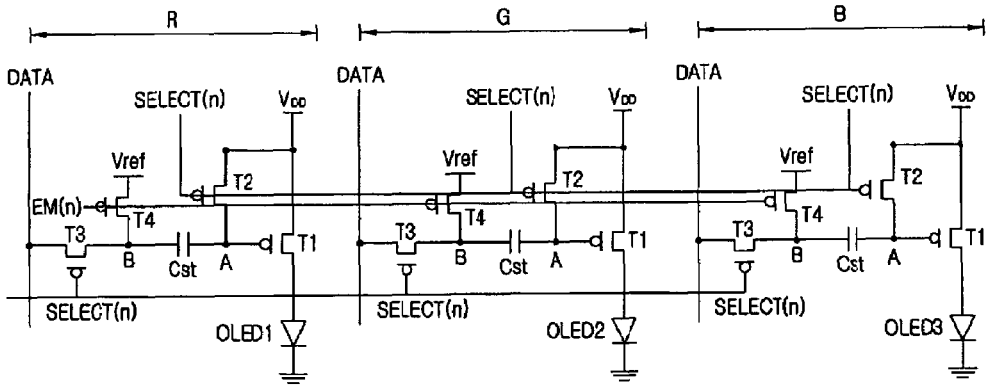
FIG. 6 is an exemplary view showing the organic light emitting diode device to which a Vref voltage for each RGB pixel is applied according to the second embodiment of the present invention.

FIG. 6 is an exemplary view showing the organic light emitting diode device to which a Vref voltage for each RGB pixel is applied according to the second embodiment of the present invention.

In the organic light emitting diode device according to the second embodiment of the invention, a gate line (not shown) is formed in a first direction, and a data line (not shown) and a power supply line $V_{DD}$ formed at a given interval in a second direction crossing the first direction, thereby forming one pixel region.

A second switching thin film transistor T3, an addressing element, is connected within a pixel region. A storage capacitor (hereinafter, referred to as Cst) is connected to the second switching thin film transistor T3 and the power supply line $V_{DD}$. A driving thin film transistor T1, a current source element, is connected to the storage capacitor Cst and the power supply line $V_{DD}$, and an organic light emitting diode OLED is connected to the driving thin film transistor T1.

A third switching thin film transistor T4 is connected between the second switching thin film transistor T3 and the storage capacitor Cst, and a first switching thin film transistor T2 is connected between the gate of the driving thin film transistor T1 connected to the storage capacitor Cst and the power supply line $V_{DD}$, thus coupling the gate to a SELECT (n) signal.

The third switching thin film transistor T4 is connected between the second switching thin film transistor T3 and the storage capacitor Cst, thus coupling the source thereof to a variable voltage Vref, which is a DC voltage. The gate of the second switching thin film transistor T3 is connected to the SELECT (n) signal like the first switching thin film transistor T2. Further, the gate of the third switching thin film transistor T4 is connected to an EM (n) signal.

In FIG. 5, the first and third switching thin film transistors T2 and T3 are turned ON at the section C where the SELECT (n) signal is turned ON. At this time, an A node voltage is initialized to a $V_{DD}$ and a B node voltage becomes $V_{DATA}$.

The second switching thin film transistor T3 is turned ON at the section D where the SELECT (n) signal is turned OFF and the EM (n) signal is turned ON, whereby the B node voltage becomes a Vref voltage.

At this time, the A node voltage is boostrapped by the change rate ($V_{DATA}$−Vref) of the B node voltage, and becomes "$V_{DD}-|V_{TH}|-V_{DATA}-Vref$".

In summary of this result, the current of the driving thin film transistor T1 will be shown as the following expression (2):

$$I_{OLED}=\tfrac{1}{2}K(|V_{GS}|-|V_{TH}|)^2=\tfrac{1}{2}K(V_{DD}-V_{DD}+V_{DATA}-Vref-|V_{TH}|)^2=\tfrac{1}{2}K(V_{DATA}-Vref-|V_{TH}|)^2 \quad (2)$$

Wherein K is u×Cox×W/L

Based on the result of the expression of the current, the current $I_{OLED}$ is proportional to a variable voltage Vref as in the first embodiment, and a uniform luminance between panels can be obtained by adjusting the variable voltage Vref As shown in FIG. 6, chromaticity and gamma values may be adjusted by such a circuit construction that the respective variable voltage Vref supply signals are connected for each RGB pixel configured by the circuit construction as shown in FIG. 5.

Figure 7:
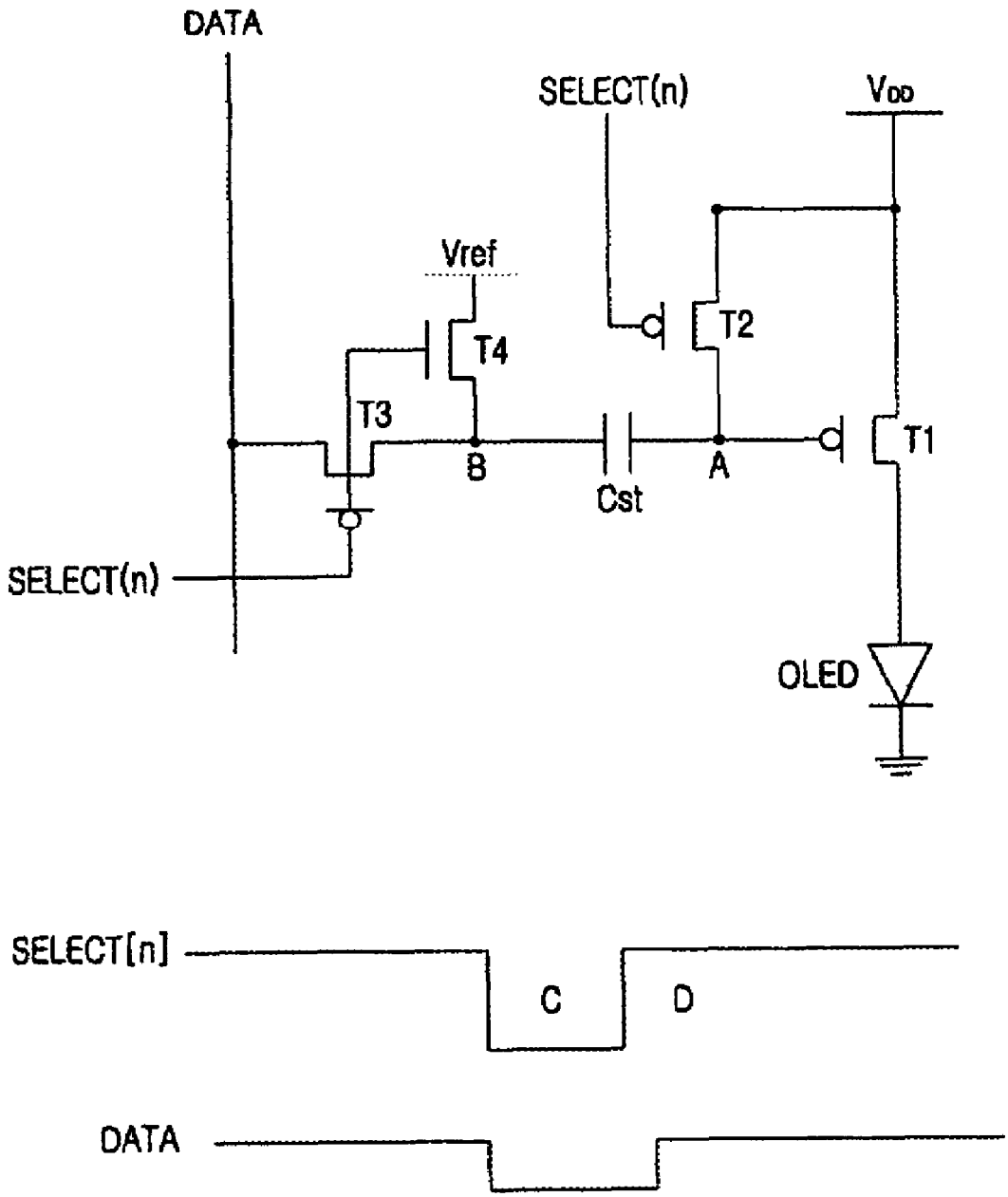
FIG. 7 is a circuit block diagram showing a unit pixel of an organic light emitting diode device according to a third embodiment of the present invention, which illustrates a case where there is no need to use an EM signal because a n type p-Si TFT is used as the third switching thin film transistor T4 in the second embodiment of the present invention.

FIG. 7 is a circuit block diagram showing a unit pixel of an organic light emitting diode device according to a third embodiment of the invention, which illustrates a case where there is no need to use an EM signal because a n type p-Si TFT is used as the third switching thin film transistor T4 in the second embodiment of the invention.

Figure 8:
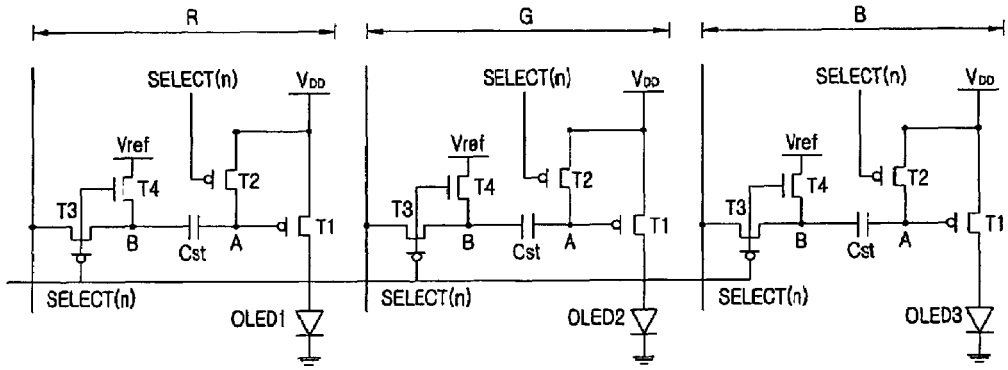
FIG. 8 is an exemplary view showing the organic light emitting diode device to which a Vref voltage for each RGB pixel is applied according to the third embodiment of the present invention.

FIG. 8 is an exemplary view showing the organic light emitting diode device to which a Vref voltage for each RGB pixel is applied according to the third embodiment of the invention.

In the organic light emitting diode device according to the third embodiment of the invention, a gate line (not shown) is formed in a first direction, and a data line (not shown) and a power supply line $V_{DD}$ formed at a given interval in a second direction crossing the first direction, thereby forming one pixel region.

A second switching thin film transistor T3, an addressing element, is connected within a pixel region. A storage capacitor (hereinafter, referred to as Cst) is connected to the second switching thin film transistor T3 and the power supply line $V_{DD}$. A driving thin film transistor T1, a current source element, is connected to the storage capacitor Cst and the power supply line $V_{DD}$, and an organic light emitting diode OLED is connected to the driving thin film transistor T1.

A third switching thin film transistor T4 is connected between the second switching thin film transistor T3 and the storage capacitor Cst, and a first switching thin film transistor T2 is connected between the gate of the driving thin film transistor T1 connected to the storage capacitor Cst and the power supply line $V_{DD}$, thus coupling to a SELECT (n) signal.

The third switching thin film transistor T4 is connected between the second switching thin film transistor T3 and the storage capacitor Cst, thus coupling to a variable voltage Vreft, which is a DC voltage. The gate of the second switching thin film transistor T3 and the gate of the third switching thin film transistor T4 are connected to the SELECT (n) signal like the first switching thin film transistor T2.

In FIG. 7, the first and third switching thin film transistors T2 and T3 are turned ON at the section C where the SELECT (n) signal becomes a low value.

When the SELECT (n) signal is changed from a low value to a high value, the second switching thin film transistor T3 is turned OFF and the third switching thin film transistor T4 is turned ON, whereby the B node voltage becomes a Vref voltage.

At this time, the A node voltage is boostrapped by the change rate ($V_{DATA}$−Vref) of the B node voltage, and becomes "$V_{DD}-|V_{TH}|-V_{DATA}-Vref$".

In summary of this result, the current of the driving thin film transistor T1 will be shown as the following expression (3):

$$\begin{aligned} I_{OLED} &= 1/2K(|V_{GS}|-|V_{TH}|)^2 \\ &= 1/2K(V_{DD}-V_{DD}+V_{DATA}-Vref-|V_{TH}|)^2 \\ &= 1/2K(V_{DATA}-Vref-|V_{TH}|)^2 \end{aligned} \quad (3)$$

Wherein K is u×Cox×W/L

Based on the result of the expression of the current, the current $I_{OLED}$ is proportional to a variable voltage Vref as in the second embodiment, and a uniform luminance between panels can be obtained by adjusting the variable voltage Vref.

Besides, chromaticity and gamma values can be adjusted by such a circuit construction that respective variable voltage Vref supply portions are connected for each RGB pixel.

It is easier to compensate for the non-uniformity of the characteristics of the RGB organic light emitting diodes (OLED1, OLED2, OLED3) by applying a Vref when no current flows through driving thin film transistor T1 as compared to a conventional structure where $V_{DD}$ is applied and the current flowing through driving thin film transistor T1 is adjusted.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A driving circuit for an organic light emitting diode device comprising:

an organic light emitting diode(OLED) formed at each of a plurality of RGB unit pixels being defined by a gate line arranged in a first direction and a data line arranged in a second direction crossing the gate line;

a data driving portion for supplying a data voltage to the RGB unit pixel;

a power supply portion for supplying a high potential voltage to the RGB unit pixel;

a driving thin film transistor having a source terminal connected to the power supply portion and a drain terminal connected to the OLED to supply a current to the OLED;

a first switching thin film transistor having a gate terminal connected to the gate line and a source terminal connected to the data line;

a storage capacitor having terminals connected to the drain terminal of the first switching transistor and the gate terminal of the driving thin film transistor;

a second switching thin film transistor having a drain terminal connected to the drain terminal of the first switching thin film transistor and the one terminal of the storage capacitor;

a third thin film transistor having a source terminal connected to the power supply portion and a drain terminal connected to the gate terminal of the driving thin film transistor and one terminal of the storage capacitor;

a variable voltage portion connected to one side node of the storage capacitor to which the data driving portion is connected through the second switching thin film transistor to supply a different voltage to each of RGB unit pixel; and at least one control signal supply portion including a first pulse signal portion and a second pulse signal portion generating and applying a first pulse signal or/and a second pulse signal to control the first to third switching thin film transistors, wherein the first to third switching thin film transistors maintain a data voltage charged to the storage capacitor by connecting the one side node of the storage capacitor to the variable voltage portion for supplying the variable voltage smaller than the data voltage and by floating electrically the other side node of the storage capacitor, and the first to third switching thin film transistors control the amount of current of the driving thin film transistor, wherein the first pulse signal portion is connected to the first switching thin film transistor and at least one switching thin film transistor of the second switching thin film transistor and the third switching thin film transistor and the second pulse signal portion is connected the other switching thin film transistor so that a first pulse signal is supplied to the switching thin film transistors connected to the first pulse signal portion to turn these on simultaneously and the second pulse signal is supplied to the switching thin film transistors connected to the second pulse signal portion to turn these on simultaneously.

2. The driving circuit of claim 1, further comprising a fourth thin film transistor having a source terminal connected to the drain terminal to the driving thin film transistor and a drain terminal connected to the OLED.

3. The driving circuit of claim 2, wherein the second pulse signal is supplied to the fourth thin film transistor to turn on thereof.

4. A method for an organic light emitting diode device, the organic light emitting diode device including:

an organic light emitting diode(OLED) formed at each of a plurality of RGB unit pixels being defined by a gate line arranged in a first direction and a data line arranged in a second direction crossing the gate line;

a data driving portion and a power supply portion;

a driving thin film transistor having a source terminal connected to the power supply portion and a drain terminal connected to the OLED;

a first switching thin film transistor having a gate terminal connected to the gate line and a source terminal connected to the data line;

a storage capacitor having terminals connected to the drain terminal of the first switching transistor and the gate terminal of the driving thin film transistor;

a second switching thin film transistor having a drain terminal connected to the drain terminal of the first switching thin film transistor and the one terminal of the storage capacitor;

a third thin film transistor having a source terminal connected to the power supply portion and a drain terminal connected to the gate terminal of the driving thin film transistor and one terminal of the storage capacitor;

a variable voltage portion connected to one side node of the storage capacitor to which the data driving portion is connected through the second switching thin film transistor to supply a different voltage to each of RGB unit pixel; and at least one control signal supply portion including a first pulse signal portion and a second pulse signal portion generating and applying a first pulse signal and/or a second pulse signal to control the first to third switching thin film transistors, the method comprising:

supplying the high potential voltage to the RGB unit pixel; and supplying a first pulse signal to the switching thin film transistors connected to the first pulse signal portion to turn these on simultaneously and supplying the second pulse signal to the switching thin film transistors connected to the second pulse signal portion to turn these on simultaneously, whereby the one side node of the storage capacitor is connected to the variable voltage portion for supplying the variable voltage smaller than the data voltage and other side node of the storage capacitor is floating electrically to maintain the data voltage charged to the storage capacitor.

5. The method of claim 4, wherein the organic light emitting diode device including a fourth thin film transistor having a source terminal connected to the drain terminal to the driving thin film transistor and a drain terminal connected to the OLED.

6. The method of claim 5, wherein supplying the second pulse signal including supplying the second pulse signal is supplied to the fourth thin film transistor.

* * * * *